US012808534B2

(12) United States Patent
Zuback

(10) Patent No.: US 12,808,534 B2
(45) Date of Patent: Nov. 24, 2026

(54) PRODUCTION OF RENEWABLE FUEL FOR STEAM GENERATION FOR HEAVY OIL EXTRACTION

(71) Applicant: Kore Infrastructure, Bozeman, MT (US)

(72) Inventor: Joseph E. Zuback, Camarillo, CA (US)

(73) Assignee: Kore Infrastructure, Bozeman, MT (US)

( * ) Notice: Subject to any disclaimer, the term of this patent is extended or adjusted under 35 U.S.C. 154(b) by 147 days.

(21) Appl. No.: 18/975,135

(22) Filed: Dec. 10, 2024

(65) Prior Publication Data

US 2025/0334264 A1 Oct. 30, 2025

Related U.S. Application Data

(63) Continuation of application No. 17/686,914, filed on Mar. 4, 2022, now Pat. No. 12,196,412, which is a (Continued)

(51) Int. Cl.
*C10G 45/02* (2006.01)
*C10B 49/02* (2006.01)
(Continued)

(52) U.S. Cl.
CPC ..... *F22B 3/02* (2013.01); *C10B 49/02* (2013.01); *C10G 31/06* (2013.01); *C10G 45/02* (2013.01); *E21B 43/24* (2013.01); *C10G 2300/202* (2013.01); *C10G 2300/207* (2013.01); *C10J 2300/1687* (2013.01); *F22B 33/02* (2013.01)

(58) Field of Classification Search
CPC . F22B 3/02; F22B 33/02; C10B 49/02; C10B 53/02; C10G 31/06; C10G 45/02; C10G 2300/202; C10G 2300/207; E21B 43/24; C10J 2300/1687; C10K 1/003
See application file for complete search history.

(56) References Cited

U.S. PATENT DOCUMENTS 4,078,973 A 3/1978 Choi et al.
4,160,479 A 7/1979 Richardson
(Continued)

FOREIGN PATENT DOCUMENTS

CA 2372111 11/2000
CA 2565477 4/2008
(Continued)

OTHER PUBLICATIONS

Bain, et al., "Biopower Technical Assessment: State of the Industry and the Technology", NREL Report No. TP-510-33123 (2003).
(Continued)

*Primary Examiner* — Randy Boyer
*Assistant Examiner* — Juan C Valencia

(57) ABSTRACT

Methods and systems are disclosed for improving the efficiency and reducing the carbon intensity of transportation fuels produced from heavy oil extracted with the steam injection process, by replacing natural gas from fossil fuel sources with a substitute renewable gas produced from solid carbonaceous materials while co-producing a solid carbonaceous byproduct.

21 Claims, 5 Drawing Sheets

Related U.S. Application Data continuation of application No. 16/869,326, filed on May 7, 2020, now Pat. No. 11,300,284.

(60) Provisional application No. 62/844,208, filed on May 7, 2019.

(51) Int. Cl.

| | |
|---|---|
| ***C10G 31/06*** | (2006.01) |
| ***E21B 43/24*** | (2006.01) |
| ***F22B 3/02*** | (2006.01) |
| ***F22B 33/02*** | (2006.01) |

(56) References Cited

U.S. PATENT DOCUMENTS

| | | | |
|---|---|---|---|
| 4,230,602 | A | 10/1980 | Bowen et al. |
| 4,436,532 | A | 3/1984 | Yamaguchi et al. |
| 7,547,390 | B2 | 6/2009 | McCorkle |
| 7,833,512 | B2 | 11/2010 | Pulkrabek et al. |
| 7,951,289 | B2 | 5/2011 | Wu et al. |
| 7,998,315 | B2 | 8/2011 | Bridgwater et al. |
| 8,547,354 | B2 | 10/2013 | Koch et al. |
| 8,845,771 | B2 | 9/2014 | Mahjoob |
| 8,999,020 | B2 | 4/2015 | Raman et al. |
| 8,999,022 | B2 | 4/2015 | Chen et al. |
| 9,260,666 | B2 | 2/2016 | Aelion et al. |
| 9,567,247 | B2 | 2/2017 | Josse et al. |
| 9,919,290 | B2 | 3/2018 | Kirk et al. |
| 9,937,458 | B2 | 4/2018 | Al-Dawood et al. |
| 10,851,630 | B2 | 12/2020 | Acosta |
| 11,046,893 | B2 | 6/2021 | Van Willigenburg |
| 11,286,507 | B2 | 3/2022 | Josse et al. |
| 2006/0243448 | A1 | 11/2006 | Kresnyak |
| 2007/0125686 | A1 | 6/2007 | Zheng |
| 2008/0236042 | A1 | 10/2008 | Summerlin |
| 2009/0020456 | A1 | 1/2009 | Tsangaris |
| 2009/0090282 | A1 | 4/2009 | Gold et al. |
| 2009/0260287 | A1 | 10/2009 | Lau |
| 2010/0282644 | A1 | 11/2010 | O'Connor |
| 2011/0061610 | A1 | 3/2011 | Speirs |
| 2011/0258914 | A1 | 10/2011 | Banasiak et al. |
| 2012/0000642 | A1 | 1/2012 | Betzer |
| 2012/0000830 | A1 | 1/2012 | Monaghan |
| 2012/0073199 | A1 | 3/2012 | Lewis |
| 2012/0270957 | A1 | 10/2012 | Kresnyak |
| 2012/0279903 | A1 | 11/2012 | Tsilevich |
| 2014/0345599 | A1 | 11/2014 | O'Donnell et al. |
| 2015/0008206 | A1 | 1/2015 | Knecht et al. |
| 2016/0138796 | A1 | 5/2016 | Hall |
| 2018/0175352 | A1 | 6/2018 | Miller et al. |

FOREIGN PATENT DOCUMENTS

| | | | | |
|---|---|---|---|---|
| CA | 2565477 | A1 * | 4/2008 | ..... C10L 1/04 |
| CA | 2672435 | | 6/2008 | |
| DE | 102014105409 | | 10/2015 | |
| WO | WO2011/049858 | | 4/2011 | |
| WO | WO2014/001580 | | 1/2014 | |
| WO | WO2023/027590 | | 3/2023 | |

OTHER PUBLICATIONS

Bain, R.L., "An Introduction to Biomass Thermochemical Conversion", Presentation at DOE/NASLUGC Biomass and Solar Energy Workshops Aug. 3-4, (2004).

Basinas, P., et al., "Pyrolysis of the Anaerobic Digestion Solid By-Product: Characterization of Digestate Decomposition and Screening of the Biochar use as Soil Amendment and as additive in Anaerabic Digestion,"Energy Conversion and Management, vol. 277, Jan. 10, 2023, 12 pages.

Biochar—Wikipedia https://en.wikipedia.org/wiki/Biochar (Year: 2020).

Bridgewater, T., "A Guide to Fast Pyrolysis of Biomass for Fuels and Chemicals, PyNe Guide 1", www.pyne.co.uk, (1999).

Brown, R. C., "Biorenewable Resources: Engineering New Products From Agriculture", Iowa State Press, ISBN:0-8138-2263-7 (2003); 2 parts.

Deng, C., et al., "Improving Gaseous Biofuel Yield From Seaweek Through a Cascading Circular Bioenergy System Integrating Anaerobic Digestion and Pyrolysis", Renewable and Sustainable Energy reviews, vol. 128, May 11, 2020, 20 pgs (2020).

Higman, et al., :Gasification, Elsevier Science (USA), ISBN 0-7506-7707-4 (2003) 3 parts.

Jones, et al., Process Design and Economics for the Conversion of Lignocellulosic Biomass to Hydrocarbon Fuels. Prepared for the U.S. Department of Energy Bioenergy Technologies Office. Solar-generated steam for oil recovery: Reservoir simulation, economic analysis, and life cycle assessment (2013).

Lui, J., et al., "A critical review on the principles, applications, and challenges of waste-to-hydrogen technologies", Renewable and Sustainable Energy Reviews, Elseviers Science, vol. 134 (2020).

Oreggioni, G., et al. "Agricultural greenhouse CO2 utilization in anaerobic-digestion-based biomethane production plants: A techno-economic and environmental assessment and comparison with CO2 geological storage", Applied Energy, 242 (2019) (1753-1766).

Probstein, et al., Chapter 10: Economics and Perspective in: Synthetic Fuels, McGraw-Hill, Inc.. , ISBN 0-07-050908-5 (1982) pp. 442-455.

Probstein, et al., Chapter 8: Biomass Conversion in: Synthetic Fuels, McGraw-Hill, Inc. (1982), ISBN 0-07-050908-5 pp. 381-410.

Tayibi, S., et al., "Synergy of Anaerobic Digestion and Pyrolysis Processes for Sustainable Waste Management: A Critical Review and Future Perspectives", Renewable and Sustainable Energy Reviews, vol. 152, Sep. 22, 2021, 20 pgs (2021).

Turner, J., et al., "Renewable hydrogen production", International Journal of Energy Research, 2007, 29 pgs.

Van Loo, et al., Chapter 11: Research and Development: Needs and Ongoing Activities in: The Handbook of Biomass Combustion and Co-firing, Twente University Press, ISBN 9036517737 (2002) pp. 391-396.

Van Loo, et al., Chapter 5: Combustion Technologies for Industrial and District Heating Systems in: The Handbook of Biomass Combustion and Co-firing, Twente University Press, ISBN 9036517737 (2002) pp. 134-174.

Van Loo, et al., Chapter 6: Power Generation and Co-generation in: The Handbook of Biomass Combustion and Co-firing, Twente University Press, ISBN 9036517737 (2002) pp. 175-202.

Van Loo, et al., Chapter 7: Co-combustion in: The Handbook of Biomass Combustion and Co-firing, Twente University Press, ISBN 9036517737 (2002) pp. 203-248.

* cited by examiner

Fig. 4

Plant A

Feedstock Data

| Test Description | As Received Basis | Dry Basis |
|---|---|---|
| Moisture, % | 3.07 | |
| Volatile Matter, % | 55.2 | 56.9 |
| Ash, % | 30.49 | 31.46 |
| Fixed Carbon, % | 11.24 | 11.64 |
| Sulfur, % | 3.97 | 4.10 |
| Calorific Value, Gross, BTU/Lb | 6,079 | 6,272 |
| Carbon, % | | 32.92 |
| Hydrogen, % | | 4.85 |
| Nitrogen, % | | 4.87 |
| Oxygen (by difference), % | | 21.80 |

Resultant Gas

| GAS | % |
|---|---|
| Methane | 13 |
| Ethane | 0.1 |
| Ethylene | 0.1 |
| Propylene | 0.4 |
| C6+ | 2.1 |
| CO2 | 13 |
| CO | 21 |
| H2 | 43 |
| H2S | 1.1 |
| BTU/cf | 461 |

Biochar Data

| Test Description | As Received Basis | Dry Basis | Test Method |
|---|---|---|---|
| Moisture, % | 0.21 | | (ASTM D4931) |
| Volatile Matter, % | 3.7 | 3.7 | (ASTM D6374) |
| Ash, % | 64.85 | 64.99 | (ASTM D4422) |
| Fixed Carbon, % | 31.24 | 31.31 | (ASTM D5172) |
| Sulfur, % | 7.33 | 7.35 | (ASTM D4239) |
| Calorific Value, Gross, BTU/Lb | 4,242 | 4,251 | (ASTM D5865) |
| Carbon, % | | 25.08 | (ASTM D5373) |
| Hydrogen, % | | 0.63 | (ASTM D5373) |
| Nitrogen, % | | 0.85 | (ASTM D5373) |
| Oxygen (by difference), % | | 1.10 | (by difference) |

Fig. 5

Plant B

Feedstock Data

| Test Description | As Received Basis | Dry Basis |
|---|---|---|
| Moisture, % | 7.88 | |
| Volatile Matter, % | 58.5 | 63.5 |
| Ash, % | 24.63 | 26.74 |
| Fixed Carbon, % | 8.99 | 9.76 |
| Sulfur, % | 1.91 | 2.07 |
| Calorific Value, Gross, BTU/Lb | 7,030 | 7,631 |
| Carbon, % | | 40.44 |
| Hydrogen, % | | 4.98 |
| Nitrogen, % | | 7.41 |
| Oxygen (by difference), % | | 18.36 |

Resultant Gas

| [illegible] | [illegible] |
|---|---|
| Methane | 15 |
| Ethane | 2.8 |
| Ethylene | 5 |
| Propylene | 3.6 |
| C6+ | 1.8 |
| CO2 | 15 |
| CO | 15 |
| H2 | 29 |
| H2S | 3.1 |
| BTU/cf | 717 |

Biochar Data

| Test Description | As Received Basis | Dry Basis | Test Method |
|---|---|---|---|
| Moisture, % | 0.17 | | (ASTM D4931) |
| Volatile Matter, % | 7.4 | 7.4 | (ASTM D6374) |
| Ash, % | 57.61 | 57.71 | (ASTM D4422) |
| Fixed Carbon, % | 34.82 | 34.89 | (ASTM D3172) |
| Sulfur, % | 1.85 | 1.85 | (ASTM D4239) |
| Calorific Value, Gross, BTU/Lb | 5,485 | 5,494 | (ASTM D5865) |
| Carbon, % | | 36.48 | (ASTM D5373) |
| Hydrogen, % | | 0.27 | (ASTM D5373) |
| Nitrogen, % | | 2.99 | (ASTM D5373) |
| Oxygen (by difference), % | | 0.70 | (by difference) |

PRODUCTION OF RENEWABLE FUEL FOR STEAM GENERATION FOR HEAVY OIL EXTRACTION

CROSS-REFERENCE TO RELATED APPLICATIONS

This application is a continuation of U.S. patent application Ser. No. 17/686,914, filed on Mar. 4, 2022 (U.S. Pat. No. 12,196,412) which is a continuation of U.S. patent application Ser. No. 16/869,326 filed on May 7, 2020 (U.S. Pat. No. 11,300,284) and claims priority to U.S. Provisional Patent Application No. 62/844,208, "Systems and Methods for Production of Renewable Fuel for Steam Generation For Heavy Oil Extraction", filed on May 7, 2019. The foregoing applications are hereby incorporated by reference in their entirety.

BACKGROUND

The present invention is in the technical field of renewable fuel production. More particularly, the present invention is in the technical field of production of renewable fuel used to generate steam used for heavy oil extraction.

Renewable fuels have had periods of popularity and periods of disfavor, with their relevance often being tied to the global fossil fuel market. Renewables have generally been considered to have drawbacks including costs of production and overall heating capabilities that are typically lower than traditional hydrocarbons, such as natural gas, octane and other hydrocarbons. The costs and efficiencies of the renewable space have been under development for many years, in an effort to address these issues.

Beyond seeking to improve the central efficiencies of such processes, the extraction of heavy oil from underground oil formations requires reduction of the oil viscosity to enable the flow of oil from the formation to the oil lift pump. Oil viscosity is reduced by heating the formation via heating processes such as steam flooding or steam-assisted gravity drainage by injecting into the oil formation low-pressure steam produced by steam generators that typically use natural gas, a fossil fuel, as the heat source. Combustion of natural gas for steam generation produces carbon dioxide, a greenhouse gas, and can represent a significant fraction of the total greenhouse gas emissions and carbon intensity associated with the use of transportation fuels refined from heavy oil extracted with the steam injection method. One method to reduce the carbon intensity of heavy oil production with the steam injection method is to use large mirrors to concentrate sunlight via solar thermal and boil water to produce steam. One drawback of this approach is the high capital cost of solar thermal steam generation equipment and installation necessary to replace existing gas-fired steam generators. Another drawback is that solar thermal steam generators are sensitive to disruption from dust storms and weather variations that affect solar intensity that will produce variable steam output and can potentially cause health, safety, and maintenance issues. Another drawback is that the variable steam output from solar thermal steam production requires supplemental steam production via gas-fired steam generators increasing the complexity and operating attention required for heavy oil extraction via steam injection.

It would be desirable to improve the process for the production of steam used in heavy oil extraction to address these and other current drawbacks, providing a process that generates steam and extracts heavy oil with lower fuel costs through a reduced or even negative carbon footprint. It would also be desirable to improve the process by reducing the outlay of required capital equipment while at the same time reducing or eliminating the potential impact of the unpredictability of weather.

SUMMARY

Disclosed herein are improved methods and systems for efficiently extracting fuels from heavy oil with a reduced or negative carbon footprint. The methods and systems provide a renewable gaseous fuel suitable for replacing natural gas used to generate steam necessary for heavy oil extraction and may recycle intermediates to further facilitate the carbon and energy efficiency of the process. In implementations, the renewable fuel is produced so as to be compatible for use in steam generators used to generate steam which is then injected into heavy oil formations as a means to reduce the total carbon intensity of transportation fuels produced from heavy oil.

The systems and methods are configured to decrease the carbon footprint of a heavy oil extraction process. The systems implement a gas production process, with methods that provide an input fuel that can be used to produce steam or in the gas production process and use it to heat a carbon-based, solid input (e.g., carbon-based waste). The gas production process provides an output of renewable fuel gas for steam generation to be used in heavy oil extraction, and a solid, carbon-based output product that contains carbon removed from the atmosphere via plant growth that can be sequestered via various means that, taken together reduce the carbon footprint of the extraction process.

In some implementations, methods for heavy oil extraction by a reduced-carbon process include receiving a heating gas and a solid, carbon-based input in a gas production process, heating the solid carbon-based input by the heating gas to produce an output gas and a carbonaceous solid output, and using the output gas (or a portion thereof) to provide energy for a steam generator. The steam from the steam generator is then used in the heavy oil extraction process.

The heating gas typically includes natural gas from a natural gas source, although other carbon-based fuels may also be used. A stream of the output gas may be recycled and included as an input into the gas production process. The stream of recycled gas includes methane and other gasses that produce heat when combusted. In implementations, the first portion of the output gas has a first calorific value of about 600 BTU/cf, or between about 250 BTU/cf and about 1100 BTU/cf, or between about 400 Btu/cf and about 850 BTU/cf, or between about 550 BTU/cf and about 700 BTU/cf. The output gas includes one or more of hydrogen, carbon monoxide, carbon dioxide, methane, and other hydrocarbons.

In implementations, the solid input material is a feed material and the heating of it is accomplished by applying an external heat source without oxygen under anaerobic conditions (anoxic) to prevent combustion of the solid input material. At least a portion of the input may be a biogenic plant material that was produced by converting atmospheric carbon dioxide and water into carbohydrates, lignins, and other plant materials via photosynthesis. The output solid may be a residual carbonaceous solid, and it will typically exit the gas production process separately from the output gas.

In some implementations, the first portion of the output gas is subject to a hydrogen separation process to create hydrogen gas and a tail gas. The tail gas may include one or more of methane, ethane, ethylene, propylene, C6+ hydrocarbons, carbon monoxide, carbon dioxide, and hydrogen and may be recycled as an input to the gas production process.

The separated hydrogen gas may have a purity of over 80 percent. The tail gas may have a calorific value above 600 BTU/cf, or between about 250 BTU/cf and about 1100 BTU/cf, or between about 400 Btu/cf and about 850 BTU/cf, or between about 550 BTU/cf and about 700 BTU/cf. Hydrogen from the separation unit may be sent to a hydrotreating facility and used therein to treat a portion of the heavy oil output from the heavy oil extraction process. That treatment may involve removing one or more contaminants of the heavy oil output, such as sulfur, a sulfur compound, nitrogen, a nitrogen compound, a volatile metal compound, an olefin, or an aromatic compound. The treatment may involve hydrodesulphurization of the heavy oil, for lowering emission of sulfur dioxide during combustion of a fuel obtained from the heavy oil output.

In some implementations, the gas production process occurs by pyrolysis. Pyrolysis may be done at a temperature of up to about 800° C. The temperature may be between about 400° C. and about 800° C., or between about 450° C. and about 750° C. The temperature may be between about 500° C. and about 700° C. The temperature may be about 600° C. The pyrolysis heating rate is between about 1° C./min and about 15° C./min. In some implementations, the heating rate is between about 4° C./min and about 12° C./min. In certain implementations, the heating rate is between about 7° C./min and about 9° C./min. In some implementations, the heating rate of the pyrolysis is about 8° C./min.

Systems may be built and provided to implement one or more methods that carry out the above described processed. Further implementations and adaptations will occur to a skilled person upon review of this disclosure and its accompanying claims and drawings.

BRIEF DESCRIPTION OF THE DRAWINGS

FIGS. 4 and 5 illustrate compositions of feedstocks used in gaseous fuel product analyses, as well as data describing the produced gaseous fuel products and biochar products implemented using one or more of the methods and systems disclosed herein.

DETAILED DESCRIPTION

The following detailed description represents example modes for carrying out the methods and systems envisaged. The description is not to be taken in a limiting sense, but is made merely for the purpose of illustrating the general principles.

Methods and systems are disclosed herein for extracting heavy oil through a reduced carbon footprint process. More particularly, the process produces renewable gaseous fuel to replace natural gas used to generate steam for heavy oil extraction. The renewable fuel reduces the carbon footprint of fuel combustion used to produce heat necessary for generating steam for the heavy oil extraction and may be recycled to power the gas production process itself, thereby powering heavy oil extraction through a reduced carbon process. Byproducts of the renewable fuel can be further harnessed and used to treat the heavy oil extracted, to achieving further efficiencies and reduction in the carbon footprint of the process.

The methods and systems integrate production of a renewable gaseous fuel with production of a solid residual containing elemental carbon (e.g., charcoal, char, biochar) that can be sequestered to prevent return to the atmosphere as $CO_2$. The solid residuals may also be sold commercially, or used as concrete additives, soil amendments, or solid fuel. The methods and systems can utilize a wide variety of biogenic carbonaceous feedstocks generally considered wastes, such as agricultural wastes, animal manure, high hazard forestry waste, municipal wastewater treatment plant biosolids, food wastes, demolition wood and non-biogenic carbonaceous feedstocks such as waste plastics and tires that contain biogenic components.

The systems and methods disclosed herein have other advantages over the use of natural gas (alone) as a steam generator fuel or solar energy for producing steam for steam injection extraction of heavy oil. The economic efficiency of oil production carried out according to the methods described herein can be significantly higher than production involving the use of either natural gas or solar thermal energy to generate steam for heavy oil extraction. This efficiency may be achieved because of the availability of abundant waste materials that are suitable feed sources for production of renewable gas, the multi-functional use of the carbonaceous solid byproduct as a fuel, and the overall beneficial environmental impact of using a renewable fuel to replace a fossil fuel (particularly by reducing the carbon intensity of transportation fuels).

Figure 1:
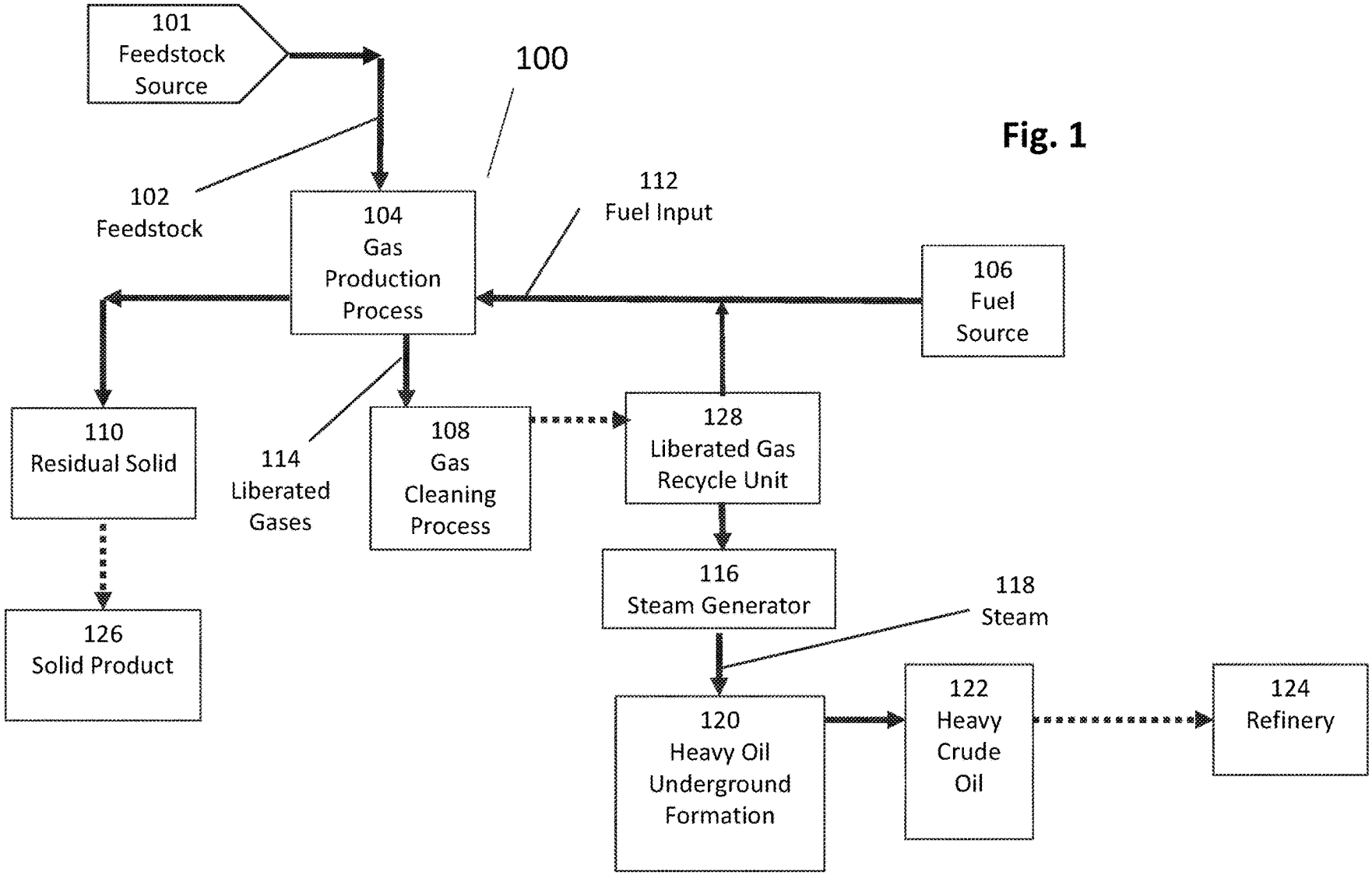
FIG. 1 illustrates a system and method for producing a renewable gaseous fuel suitable for use in gas-fired steam generators used to generate steam for injection into heavy oil formations, according to an illustrative implementation.

FIG. 1 illustrates a system 100 for executing a method of producing a renewable gaseous fuel suitable for use in gas-fired steam generators that generate steam for injection into heavy oil formations. System 100 has a gas production process 104 that receives an input feedstock 102 from a feedstock source 101 and an input from a fuel source 106 to produce liberated gases 114 and residual carbonaceous solid 110. Fuel source 106 may combine with various recycle streams to yield fuel input 112, also referred to as heating gas, as discussed below. The system has a gas cleaning process 108 that receives the liberated gases 114 and processes them for sending to steam generator 116 to power the production of steam 118. Before the steam generation, the liberated gases 114 are sent to a recycling unit 128 that splits the stream of liberated gases 114 to enable both recycling of a portion of the liberated gases 114 back to the gas production process 104 via fuel input (heating gas) 112 and use of the liberated gases as fuel for steam production in steam generator 116. Steam 118 from the steam generator 116 is processed and used in heavy oil extraction, as explained further below.

Feedstock source 101 provides input feedstocks 102 to gas production process 104. Suitable feedstocks 102 include carbon-based material and may be selected from a variety of biogenic carbonaceous feedstocks generally considered wastes, such as agricultural wastes, animal manure, high hazard forestry waste, municipal wastewater treatment plant biosolids, food wastes, demolition wood, and non-biogenic carbonaceous feedstocks such as waste plastics and tires that contain biogenic components.

Gas production process 104 is generally anoxic, typically involving an anoxic heating process. In general, gas production process 104 is executed at a temperature that liberates combustible gases 114 and a residual carbonaceous solid 110 from the input feedstocks 102 obtained from feedstock source 101. The combustible, liberated gases 114 have sufficient calorific value that can be harvested and used in steam generation. The calorific value of the liberated gases 114 also can provide the heat required for heating the input feedstock 102 obtained by gas production process 104 from feedstock source 101 (or at least a portion thereof). As indicated in the figures, harvesting and using the liberated gases 114 and extracting the residual carbonaceous solid serves to reduce the carbon footprint of the overall process. That reduction can be further enhanced by recycling the liberated gases 114 into the gas production process 104.

Gas production process 104 may be done by pyrolysis. The pyrolysis may occur over a range of temperatures, the optimal temperature being selected as needed to liberate sufficient combustible gas from the specific feedstock 102. The temperature may be up to about 800° C. The temperature may be between about 400° C. and about 800° C., or between about 450° C. and about 750° C. The temperature may be between about 500° C. and about 700° C. The temperature may be about 600° C.

The pyrolysis may also occur over a range of heating rates, the optimal rate being selected in conjunction with the desired temperature based on the selected inputs (feedstocks) 102. In some implementations, the heating rate is between about 4° C./min and about 12° C./min. In certain implementations, the heating rate is between about 7° C./min and about 9° C./min. In some implementations, the heating rate of the pyrolysis is about 8° C./min. Other methods of gas production may be used (e.g., combustion, carbonization, charring, devolatilization) with similar or identical temperatures and heating rates to the pyrolysis conditions discussed above.

As indicated, gas production process 104 receives fuel as an input from fuel source 106, which may include natural gas. Fuel source 106 may combine various recycle streams or other inputs to yield fuel input 112 as the final heating gas input to the gas production process 104 (discussed for example below in relations to FIGS. 2 and 3). By utilizing recycle streams (e.g., a portion of liberated gases 114) as a component of fuel input 112 to enhance the natural gas from fuel source 106, the heating gas fuel input 112 is enhanced through the gas production process, the efficiency of the overall oil production is further increased, and the carbon footprint of the overall oil production process is further improved.

As discussed above, a residual carbonaceous solid 110 is obtained from the input feedstocks 102 obtained from feedstock source 101. Residual solid 110 may be further refined to yield solid product 126, which may include solid fuels, soil amendments, concrete additives, and other carbon products. Accordingly, solid product 126 also improves the carbon footprint of the process. Solid product 126 may be further refined or sold as desired.

Liberated gases 114 (the volatile gases liberated by the gas production process) are subsequently treated in gas cleaning step 108. Gas cleaning step 108 may be implemented to remove soot particles and non-desirable gases, such as acidic gases like hydrogen sulfide, hydrogen chloride, hydrogen fluoride, ammonia, volatilized metals, carbon dioxide or other undesirable gases that condense into liquids or reduce the heat value of the gas.

After the gas cleaning process 108, liberated gases 114 are directed to a recycle unit 128 that may direct a portion of liberated gases 114 back to the gas production unit, for example by joining it with a gas stream from the fuel source 106 to form as the heating gas fuel input 112. This reduces the reliance of the system 100 on natural gas and decreases its carbon footprint. The gas recycle unit 128 directs a separate portion of liberated gases 114 to steam generator 116 to provide energy for steam generation. Steam generator 116 produces steam 118 for application in heavy oil extraction. The application of liberated gases 114 to steam generator 116 can generate steam with comparable efficiency while using the same combustion control equipment designed to combust natural gas and with stack gas emissions that comply with permit requirements when combusting natural gas. Incorporation of liberated gases 114 to steam generator 116 also reduces the carbon footprint of process 100. This use of liberated gases 114 in steam generation also advantageously reduced the amount of natural gas that must be purchased to generate steam, making such a process more economical. Steam 118 is directed towards heavy oil underground formation 120 to extract heavy crude oil 122, which may then be refined in refinery 124 by heating, distillation/fractionation, blending, isomerization, reformation, alkylation, hydrotreatment, hydrocracking, coking, and/or fluid catalytic cracking.

Figure 2:
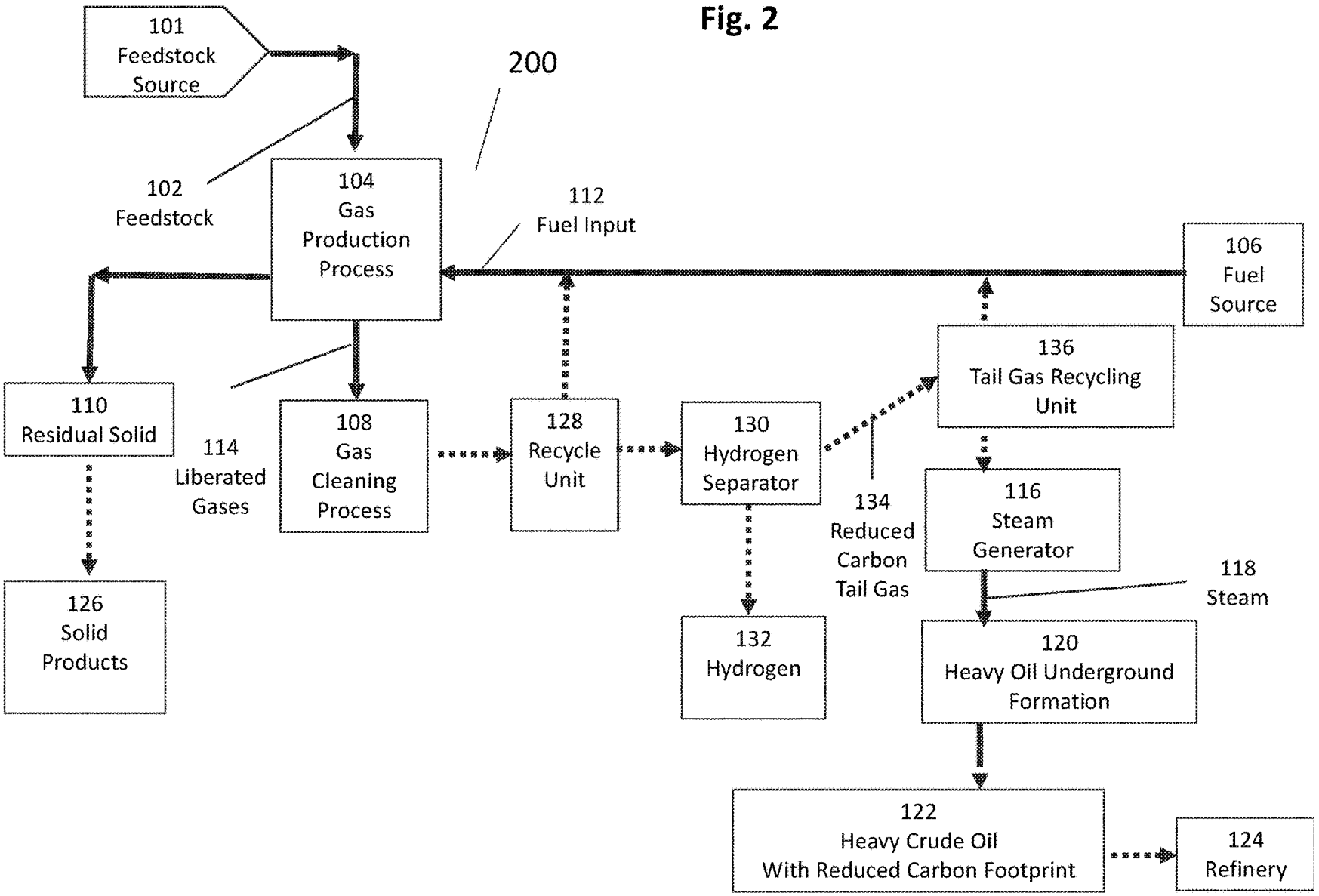
FIG. 2 illustrates a system and method for producing a renewable gaseous fuel and separating the components of the gaseous fuel into hydrogen and tail gas suitable for generating steam for injection into heavy oil formations.

FIG. 2 illustrates a system 200 with a hydrogen separation system 130 for further enhancing the efficiency and reducing the carbon footprint of the heavy oil extraction process. The hydrogen separator 130 receives the liberated gases 114 from the gas production process 104 (from the cleaning process 108) and separates the stream of liberated gases 114 into hydrogen 132 and a tail gas 134. The tail gas 134 is recycled in the recycling unit 136, where a portion of the stream is recycled to the gas production process 104, and a portion is sent to the steam generator 116 to produce steam 118 for reduced carbon extraction of heavy oil from underground formation 120.

As indicated, after the gas cleaning process 108, liberated gas stream 114 is directed to liberated gas recycle unit 128. Liberated gas recycle unit 128 may recycle a portion of liberated gases 114 into the fuel input 112 and directs the remainder to the hydrogen separator 130. The use of recycle streams advantageously lowers the dependence of the system on purchased natural gas, reducing both the fuel cost for steam generation and the carbon footprint of the overall oil extraction process.

Hydrogen separator 130 separates hydrogen 132 from liberated gases 114. Hydrogen can be selectively removed from the volatile gasses by pressure swing adsorption (PSA) and other processes. Suitable adsorbents include, but are not limited to, activated carbon, silica, zeolite, and resin. Hydrogen 132 may be sold commercially or used as fuel for an internal combustion engine or fuel cell, either stationary or in a vehicle. Hydrogen 132 may also be used in hydrotreatment of crude oil, as discussed below in relation to FIG. 3. Hydrogen separator also has as an output tail gas 134, which is directed to the recycling unit 136. Tail gas 134 has a higher heat value (BTU/cf) than liberated gases 114 because of the removal of hydrogen. Accordingly, tail gas 134 further reduces the dependence of the system on purchased natural gas, reducing fuel costs and decreasing the carbon footprint of the system.

The recycling unit 136 directs a portion of the tail gas 134 to join fuel input 112 for input into gas production process 104. The tail gas recycling unit 136 directs an additional portion of the reduced carbon tail gas 134 to steam generator 116 to provide energy for steam generation. Steam generator 116 may produce steam 118 for application in heavy oil extraction. The tail gas 134, having a calorific value ranging from about 400 BTU/cf to about 700 BTU/cf (approximately 60% to 85% of the calorific value of natural gas), can be used in steam generators designed to use natural gas, thus reducing the fuel cost for steam generation with respect to steam generation using purchased natural gas. Steam 118 is directed towards heavy oil underground formation 120 to enable extraction of heavy crude oil with reduced carbon footprint 122. Heavy crude oil with reduced carbon footprint 122 is directed towards refinery 124 for refining, for example, by heating, distillation/fractionation, blending, isomerization, reformation, alkylation, hydrotreatment, hydrocracking, coking, and/or fluid catalytic cracking.

Figure 3:
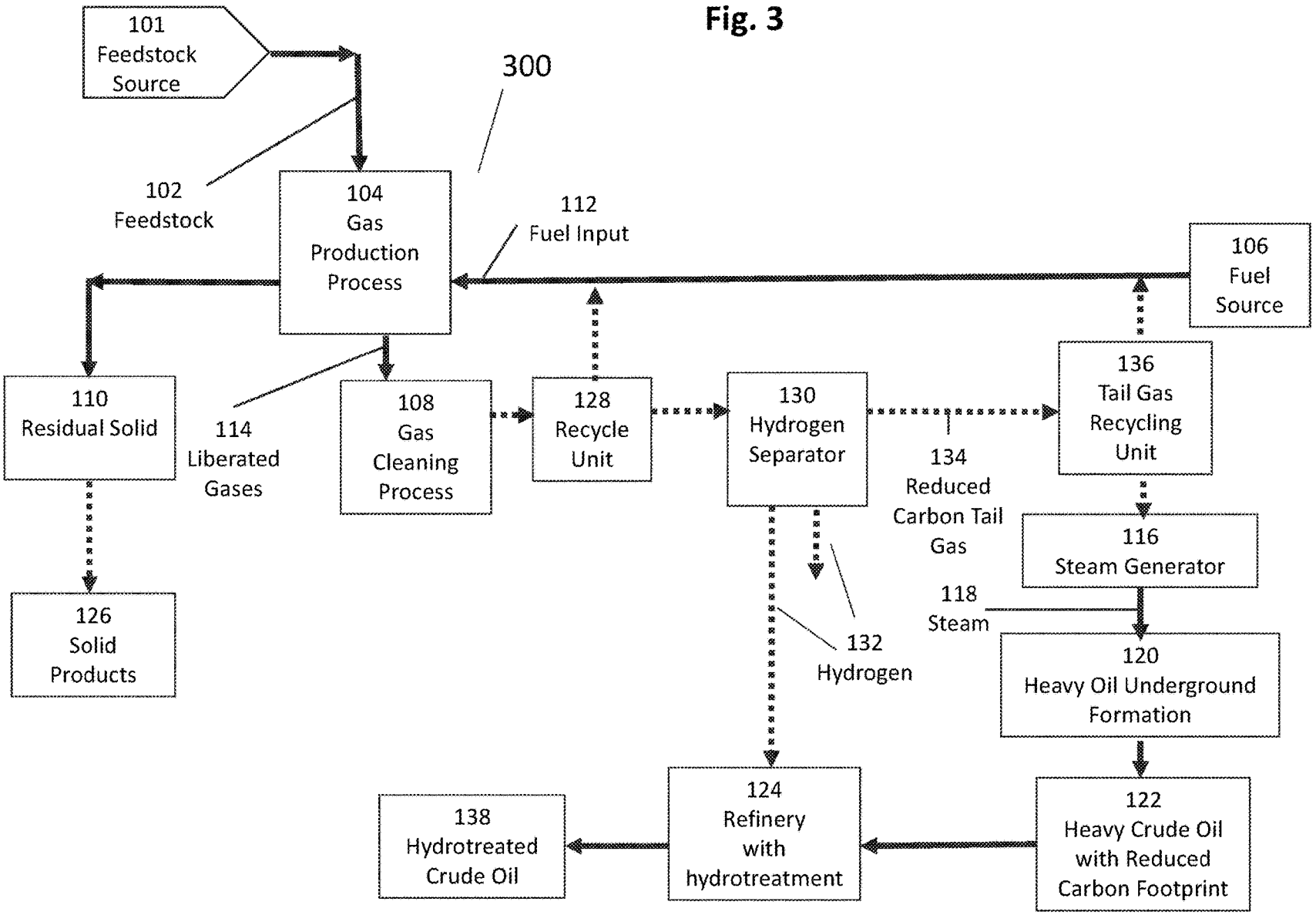
FIG. 3 illustrates a system and method for producing a renewable gaseous fuel and separating the components of the gaseous fuel into hydrogen and tail gas suitable for generating steam for injection into heavy oil formations and hydrotreating the generated heavy oil output using the separated hydrogen.

FIG. 3 illustrates a further enhancement to system 100 for producing the renewable gaseous fuel suitable to generate steam for injection into heavy oil formations. The system includes a hydrotreatment unit 124 within or near the oil field (or separately positioned inside the refinery, with a fluid flow system that transports to the refinery). The hydrotreatment unit is configured to receive hydrogen 132 from the hydrogen separator 130 and hydrotreate the crude oil, with the resulting crude oil 138 having a reduced carbon footprint 122.

Hydrotreatment in refinery 124 may utilize hydrodesulphurization. Hydrodesulphurization reduces sulfur from the extracted oil, to thereby reduce the emissions of sulfur dioxide or other undesirable gases created during combustion of fuel obtained from the heavy oil extraction. Heavy oil having a reduced carbon footprint 122 is thus extracted from heavy oil underground formation 120, and is hydrotreated in refinery 124.

FIGS. 4 and 5 illustrate compositions of feedstocks used in gaseous fuel product analyses that implement one or more of the methods disclosed herein. Feedstocks were sourced from two municipal wastewater treatment plants, Plant A and Plant B, corresponding to FIGS. 4 and 5, respectively. The feedstocks were solid, carbonaceous biogenic feedstocks, specifically municipal biosolids that were pre-dried to a moisture content that was less than 10% by weight. The biosolids were then pyrolyzed in a continuously fed pyrolysis machine that produced a biochar and an output carbon-based gas. The compositions of the biochars and the output carbon-based gases for each of plants A and B are shown in FIGS. 4 and 5, respectively. Testing was conducted to analyze the gas produced for each feedstock using the continuously fed pyrolysis machine. The pyrolysis machine heated 200 pounds per hour of feedstock for 90 minutes with an exit temperature of approximately 1000 degrees Fahrenheit. The data illustrates that a calorific gas can be produced with a heat value (BTU/cf) that ranges from 40 to 70% of the calorific value of natural gas, and thus serve as a replacement in a natural gas-fired heater. For every dry ton (2,000 pounds) of feedstock 102 that is processed, 1,000 to 4,000 standard cubic feet of natural gas with a calorific value of approximately 1,000 BTU per standard cubic foot (or equivalent product gas) will be required for heating the feedstock, 16,000 to 20,000 standard cubic feet of tail gas 134 with a calorific value of 400 to 650 BTU per standard cubic foot will be produced, and 300 to 1000 pounds of biochar will be produced. The range reflects the variance in feedstock composition (moisture, inert material, carbon-oxygen-hydrogen ratios). Accordingly, the total heat generated from combustion of tail gas 134 eclipses that of the heat generated from the combustion of natural gas. This increases the efficiency of the process.

While the foregoing written description enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiments, methods, and examples, but by all embodiments and methods within the scope and spirit of the methods and systems as claimed.

The invention claimed is:

1. A method for steam generation having a carbon footprint by a reduced-carbon process, the method comprising:

receiving, by a pyrolyzer for use in a gas production process, (a) a fuel input stream comprising carbon-based fuel and (b) a solid, carbon-based feedstock input from a renewable feedstock source, indirectly heating the solid carbon-based feedstock input by the fuel in the pyrolizer via an anaerobic pyrolysis process to produce, from the feedstock, a liberated renewable output gas, the renewable output gas having a calorific value sufficient for use in steam generation, and a carbonaceous residual solid output the carbonaceous residual solid output comprising carbon removed from the atmosphere via plant growth, thereby reducing the carbon footprint of the of the steam generation process;

directing the renewable output gas to a gas recycling unit, and dividing, by the gas recycling unit, the renewable output gas into a first portion and a second portion; and using the first portion of the renewable output gas to provide energy for a steam generator thereby reducing an amount of natural gas utilized in the steam generator.

2. The method of claim 1, wherein the fuel comprises natural gas from a natural gas source.

3. The method of claim 1, further comprising feeding the second portion of the renewable output gas.

4. The method of claim 1, wherein a stream of recycled gas includes methane and other combustible gasses.

5. The method of claim 1, wherein the calorific value of the renewable output gas is between about 250 BTU/cf and about 1100 BTU/cf.

6. The method of claim 1, wherein at least a portion of the feedstock input is obtained from a biogenic plant material that converts atmospheric carbon dioxide and water into carbohydrates, lignins, and other plant materials, or non-biogenic carbonaceous feedstocks.

7. The method of claim 1, wherein the residual carbonaceous solid exits the pyrolizer separately from the output gas.

8. The method of claim 1, wherein the output gas comprises one or more of the group consisting of hydrogen, carbon monoxide, carbon dioxide, and hydrocarbons.

9. The method of claim 8, wherein the first portion of the renewable output gas is subject to a hydrogen separation process, wherein the hydrogen separation process is configured to generate hydrogen gas and a tail gas comprising one or more of methane, butane, propane and octane, and wherein at least a portion of the tail gas is fed into the fuel input stream.

10. The method of claim 9, wherein the separated hydrogen gas has a purity of over 80 percent.

11. The method of claim 9, wherein the tail gas has a calorific value between about 250 BTU/cf and about 1100 BTU/cf.

12. The method of claim 1, wherein the pyrolysis process occurs at a temperature of between about 400° C. and about 800° C.

13. The method of claim 1, wherein the pyrolysis process occurs at a temperature between about 450° C. and about 750° C.

14. The method of claim 13, wherein a heating rate of the pyrolysis process is between about 1° C./min and about 15° C./min.

15. The method of claim 14, wherein the heating rate of the pyrolysis process is between about 5° C./min and about 10° C./min.

16. A system for steam generation having a carbon footprint by a reduced-carbon process, the system comprising:

a pyrolyzer for use in a gas production process, wherein the pyrolyzer is configured to:

receive, (a) a fuel input stream comprising carbon-based fuel and (b) a solid, carbon-based feedstock input from a renewable feedstock source, indirectly heat the solid carbon-based feedstock input by the fuel in the pyrolizer via an anaerobic pyrolysis process; and produce, from the feedstock, a liberated renewable output gas, the renewable output gas having a calorific value sufficient for use in steam generation, and a carbonaceous residual solid output, the carbonaceous residual solid output comprising carbon removed from the atmosphere via plant growth, thereby reducing the carbon footprint of the of the steam generation process;

a gas recycling unit;

wherein the pyrolyzer is configured to direct the renewable output gas to the gas recycling unit, and wherein the gas recycling unit is configured to divide the renewable output gas into a first portion and a second portion; and a steam generator configured to generate steam using energy from the first portion of the renewable output gas, thereby reducing an amount of natural gas utilized in the steam generator.

17. The method of claim 1, wherein at least a portion of the feedstock input is obtained at least in part from biogenic waste.

18. The method of claim 17, wherein the biogenic waste comprises one or more of agricultural wastes, animal manure, high hazard forestry waste, municipal wastewater treatment plant biosolids, food wastes, or demolition wood.

19. The method of claim 1, wherein at least a portion of the feedstock input is obtained at least in part from non-biogenic waste.

20. The method of claim 19, wherein the non-biogenic waste comprises one or more of waste plastics or tires that contain biogenic components.

21. The method of claim 1, comprising feeding the second portion of the renewable output gas into the fuel input stream, thereby reducing a fraction of heating gas provided by a fuel source comprising natural gas, thereby reducing a carbon footprint of the anaerobic pyrolysis process.

* * * * *